US006533676B1

(12) United States Patent
D'Angelo et al.

(10) Patent No.: US 6,533,676 B1
(45) Date of Patent: Mar. 18, 2003

(54) GOLF PUTTING AID AND BRACE MEMBER THEREFOR

(76) Inventors: Frank D'Angelo, 5985 N. Woodmont, LaSalle, Ontario (CA), N9J 3P3; Mario Dibartolomeo, 250 McCurdy, Amherstburg, Ontario (CA), N9V 3K4

( * ) Notice: Subject to any disclaimer, the term of this patent is extended or adjusted under 35 U.S.C. 154(b) by 0 days.

(21) Appl. No.: 09/433,570

(22) Filed: Nov. 4, 1999

(51) Int. Cl.[7] ..... A63B 69/36
(52) U.S. Cl. ..... 473/239; 473/296; 473/276
(58) Field of Search ..... 473/294, 293, 473/276, 212, 239, 248

(56) References Cited

U.S. PATENT DOCUMENTS

| | | | | |
|---|---|---|---|---|
| 4,625,965 A | | 12/1986 | Mullins | |
| 4,880,240 A | | 11/1989 | Lewis | |
| 5,127,650 A | | 7/1992 | Schneller | |
| 5,156,401 A | | 10/1992 | Hodgkiss | |
| 5,209,474 A | | 5/1993 | Voyer | |
| 5,308,071 A | | 5/1994 | Lewis | |
| 5,328,185 A | | 7/1994 | Finnigan et al. | |
| 5,342,055 A | | 8/1994 | Diley | |
| 5,465,971 A | * | 11/1995 | Tischler | 273/186.2 |
| 5,520,392 A | | 5/1996 | Foresi et al. | |
| 5,649,870 A | * | 7/1997 | Harison | 473/239 |
| 5,733,203 A | * | 3/1998 | Middleton | 473/248 |

OTHER PUBLICATIONS

Scott McCarron, "My Not–So–Secret Weapon", *Golf Magazine*, Nov. 1998, p. 90–91.
"Senior Player", *Golf Magazine*, Aug. 1998, p. 116.

* cited by examiner

*Primary Examiner*—Paul T. Sewell
(74) *Attorney, Agent, or Firm*—Robert Halper

(57) ABSTRACT

An improved golf putter is provided with an upper brace member portion extending above the grip of the putter. The upper brace member portion has a lower arm brace, an upper arm brace and an anchor that are all oriented to follow the underside of a golfer's forward arm from the wrists to the armpit to brace the golfer's arm in a triangulated position in order that the golfer may utilize a pendular stroke.

24 Claims, 11 Drawing Sheets

GOLF PUTTING AID AND BRACE MEMBER THEREFOR

FIELD OF THE INVENTION

The present invention relates to golf and in particular to golf putters.

BACKGROUND OF THE INVENTION

When performing a putting stroke, it is preferable that a golfer's hands, arms and shoulders occupy a triangulated position that is centered generally along the center axis between the golfer's shoulders. The hands, wrists and elbows should remain locked in order that movement of the putting stroke may be provided solely by movement of the shoulders in a pendulum action about the center axis. This allows the larger, easier to control muscles of the shoulders to be utilized rather than the small muscles of the hands and wrists which are subject to small jerks and movements that can push or pull the face of the golf putter off line.

While many golfers understand the importance of maintaining a triangulated position while putting, the actual performance of a putting stroke in this position is difficult for a golfer to learn and perform consistently.

Various devices have been developed to assist golfers in maintaining a triangulated position with locked hands and arms during a putting stroke. These include putters and putting training aids disclosed in U.S. Pat. No. 5,520,392 (Foresi, et al.) and U.S. Pat. No. 5,649,870 (Harrison).

The Foresi patent discloses a golf training device that is mounted to the shaft of a conventional putter at a point just below the hand grip. The device includes an elongate shaft having one end that extends underneath the golfer's armpit and is held in place when the golfer squeezes his arm against the shaft. The other end of the shaft extends over the golfer's arm and hands to a connection point immediately below the hand grip. One problem with this putter is that the golfer must unnaturally squeeze his upper arm against his armpit in order to hold the upper shaft in position to lock the golfer's arms. Also, the portion of the shaft that extends over the arm and hands of the golfer interferes with the golfer's line of sight of the golf ball when performing the golf stroke.

The Harrison patent discloses a putter having a straight elongated shaft having one end that is held under the golfer's armpit. Because the shaft is straight, the golfer is unable to position his arms in a triangulated position centered along the center axis between the golfer's shoulders. Accordingly, the Harrison device does not promote a balanced triangulated position for a golfer.

There is a need for an improved putter and putting training device that overcomes the above problems and assists a golfer in maintaining a triangulated position with locked arms while putting.

SUMMARY OF THE INVENTION

The present invention provides an improved golf putting aid that overcomes the above problems.

In one aspect, the invention provides a golf putting aid comprising:

an elongate shaft having first and second ends;

a grip disposed on said shaft at an intermediate point between said first and second ends;

an upper brace portion defined in said shaft between said grip and said second end, said upper brace portion including an anchor adjacent to said second end, said anchor being configured to fit comfortably against a golfer's armpit; in the case of a right handed golfer under the left armpit, and in the case of a left handed golfer under the right armpit.

at least one bend defined in said upper brace portion for locating said anchor against a golfer's armpit while the portion of said shaft located between said grip and said first end is disposed generally on an axis centered between the golfer's shoulders.

In another aspect, the invention provides a brace member for mounting to a golf putter having a putter head, a shaft and a grip, the brace member comprising:

an elongate shaft having first and second ends;

a putter attachment disposed at said first end of said shaft for attaching said brace member to the golf putter;

a brace portion defined in said shaft between said putter attachment and said second end, said brace portion including an anchor adjacent to said second end, said anchor being configured to fit comfortably within a golfer's armpit; and at least one bend defined in said brace portion for locating said anchor against a golfer's armpit while the putter attachment supports the golf putter in an axis centered between the golfer's shoulders.

In another aspect, the invention provides a brace member for a golf putter having a putter head, a shaft and a grip, said brace member comprising:

a lower arm brace for extending from said grip generally parallel to a golfer's arm between the wrist and elbow;

an upper arm brace connected to the lower arm brace, the upper arm brace extending at an angle relative to the lower arm brace so as to extend generally parallel to the golfer's arm between the elbow and the armpit when the golfer is in a putting stance; and an armpit brace connected to the upper arm brace, the armpit brace extending generally parallel to the golfer's armpit.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
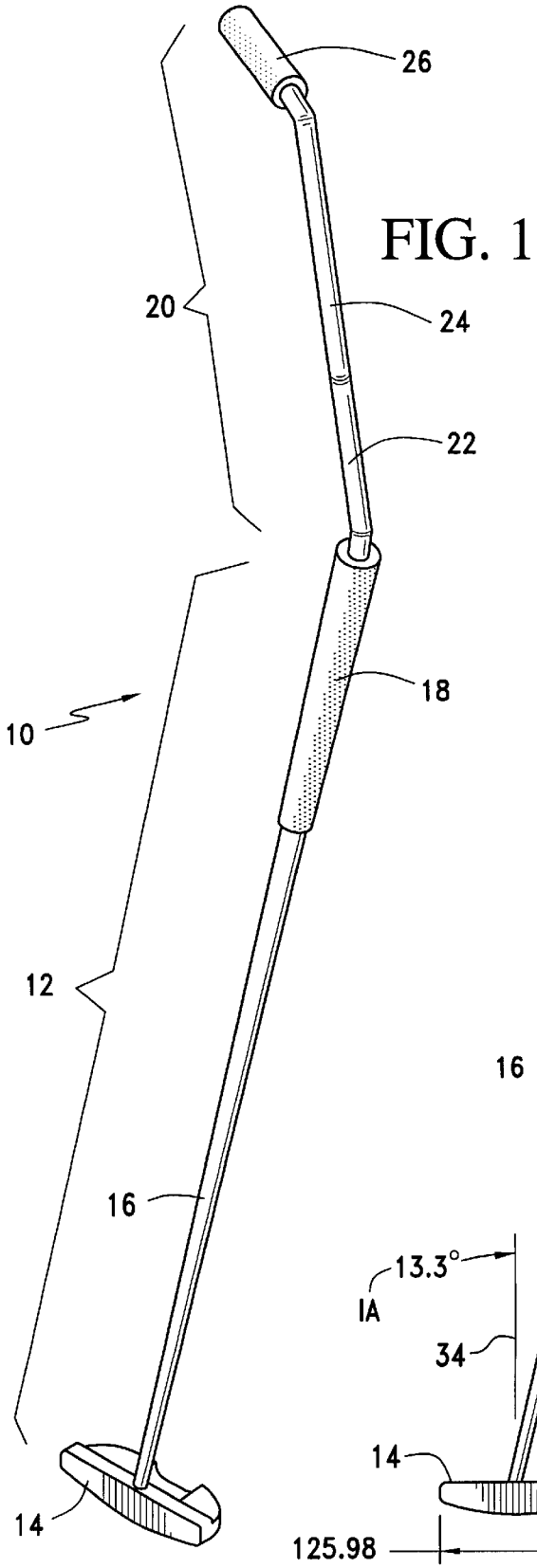
FIG. 1 is a perspective view of an improved golf putter in accordance with the present invention.
Figure 2:
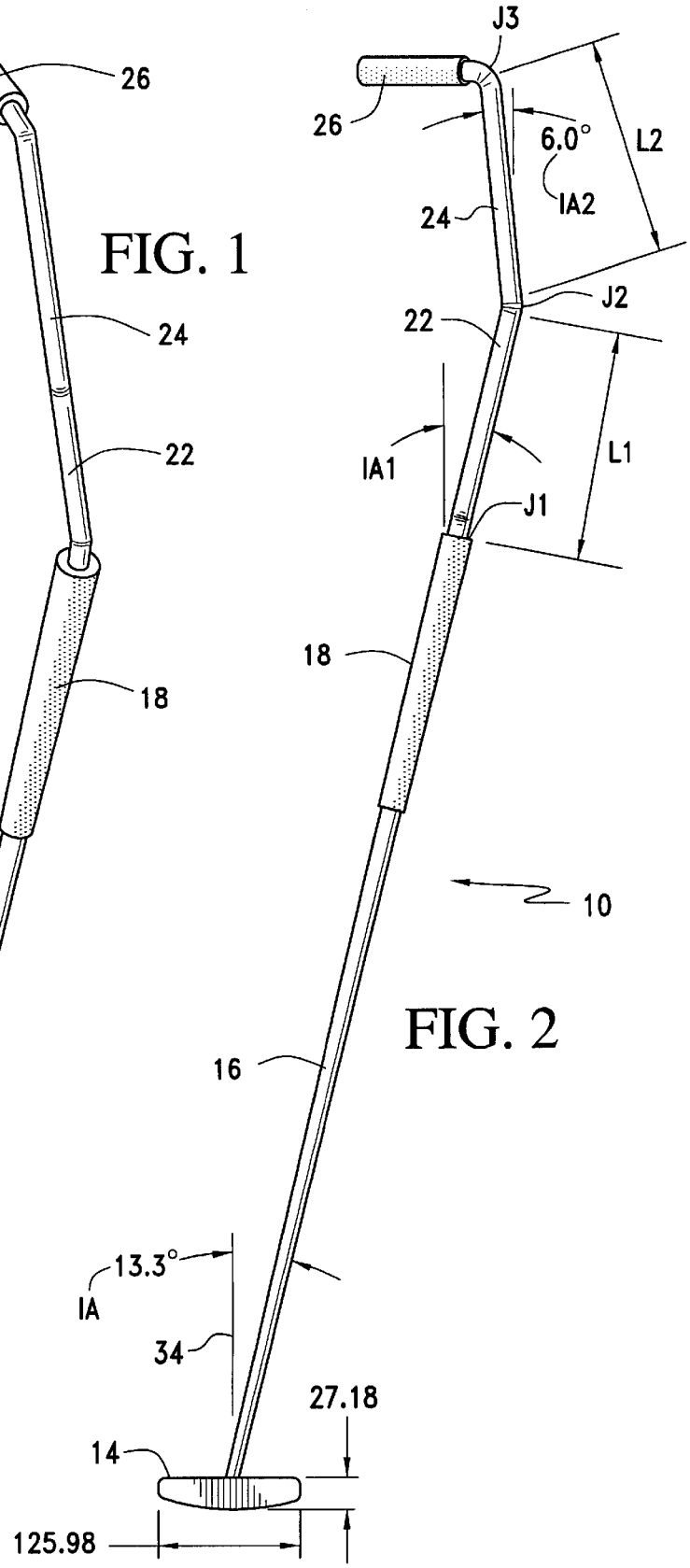
FIG. 2 is a side view of the golf putter of FIG. 1.
Figure 3:
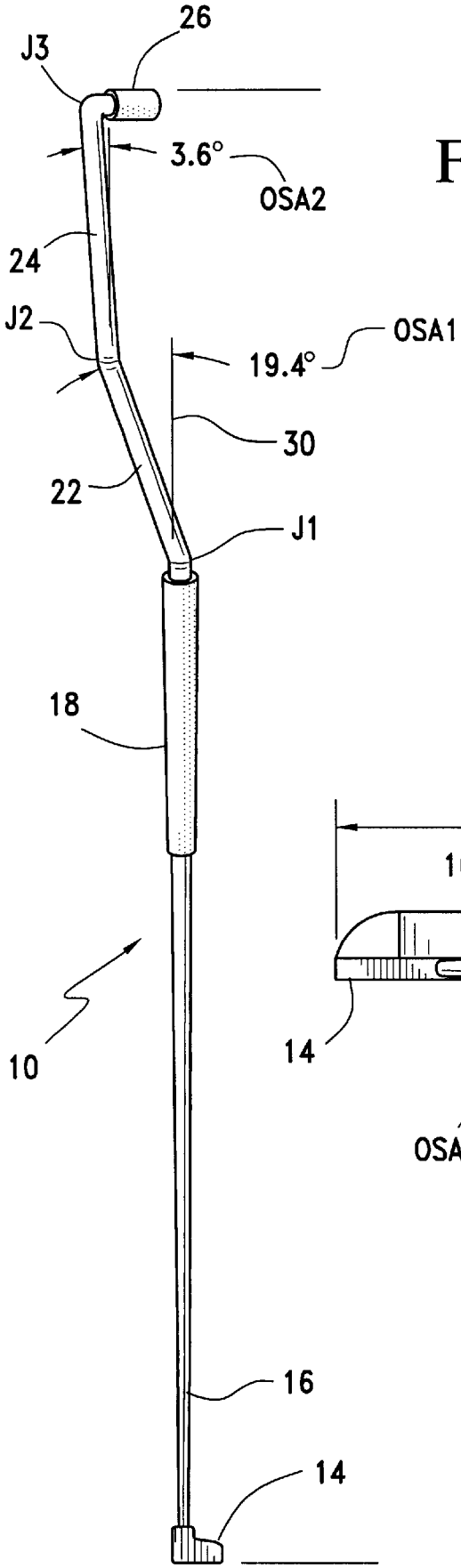
FIG. 3 is a front view of the golf putter of FIG. 1.
Figure 4:
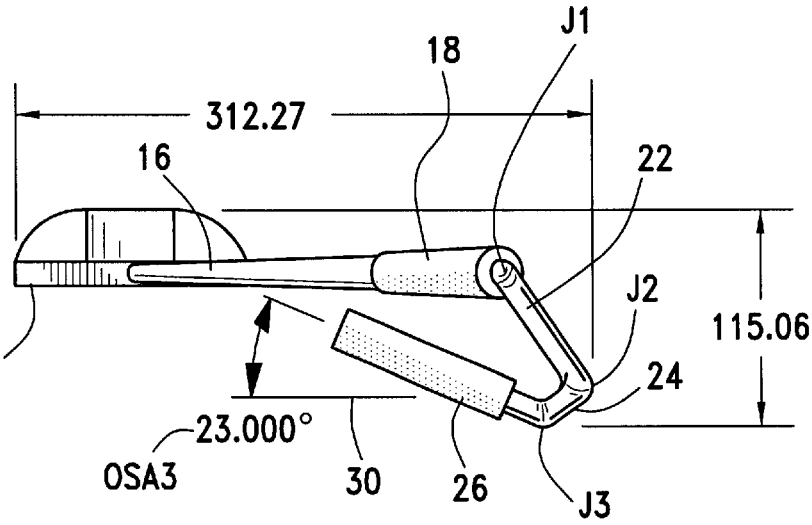
FIG. 4 is a top view of the golf putter of FIG. 1.

Referring to FIGS. 1 to 11, an improved golf putter in accordance with the present invention is shown generally at 10. The improved golf putter 10 has a lower putter portion 12 comprising a putter head 14, a shaft 16 and a grip 18. Improved golf putter 10 further includes an upper brace member portion 20 comprising a lower arm brace 22, an upper arm brace 24 and an anchor 26. Anchor 26 includes a cushioned cover 27. Braces 22 and 24 and anchor 26 are constructed from a rigid material such as steel, graphite, or other materials commonly used for golf putter shafts. The grip 18 and lower arm brace 22 connect at joint J1, the lower arm brace 22 and upper arm brace 24 connect at Joint J2 and the upper arm brace 24 and anchor 26 connect at joint J3. The joints J1, J2, and J3 may be integral bends defined in the upper brace member portion 20 or some or all of them may be distinct elements such as hinges, ball and socket joints or the like that are lockably pivotally connected to the grip 18 and braces 22 and 24. Similarly, the braces 22 and 24 may have a fixed length or they may have adjustable lengths by means of a telescoping construction (see embodiment depicted in FIGS. 12 to 17).

Figure 5A:
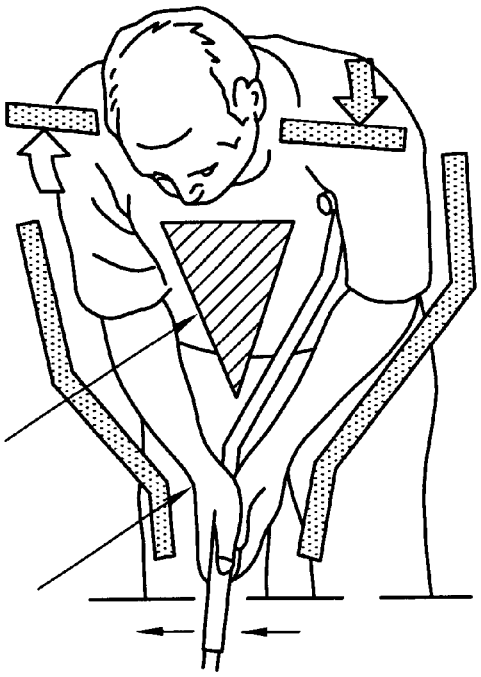
FIGS. 5(*a*) and (*b*) are front views of a golfer performing a golf stroke with the improved golf putter of FIG. 1.
Figure 5B:
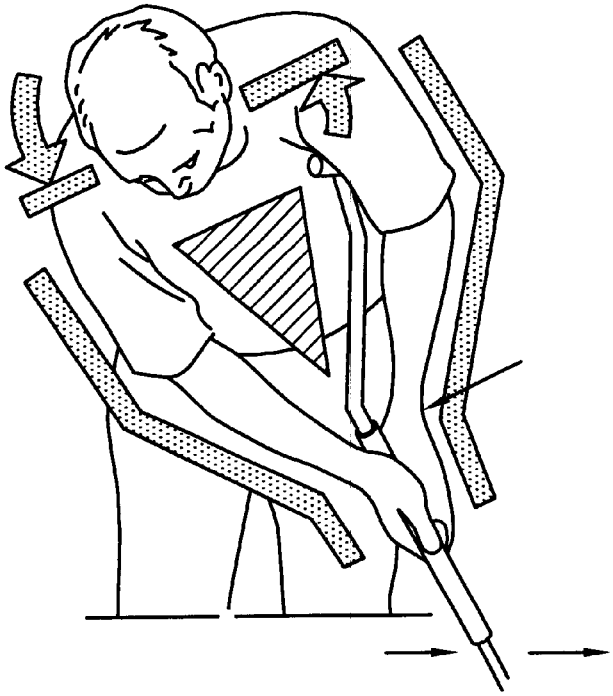

As may be seen in FIGS. 5*a* and 5*b*, the brace member portion 20 is configured to extend along the inner side of a golfer's forward arm 28(a right handed golfer's left arm) as it is positioned in a triangulated position for putting. The lower arm brace 22 has a length L1 generally corresponding to the distance between the golfer's wrist and elbow. The upper arm brace 24 has a length L2 generally corresponding to the length golfer's elbow and armpit. As a result, when a golfer grips the improved golf putter 10 in a proper triangulated position the anchor 26 will become anchored comfortably against the armpit of the golfer's forward arm 28 and the golfer's forward arm 28 will be maintained in a locked position by the lower and upper arm braces 22, 24. Note that the anchor is seated under the left arm for a right handed golfer and under the right armpit for a left handed golfer.

The upper brace member portion 20 is preferably configured to follow the angles of the golfer's forward arm 28 as it is bent in the triangulated position. Accordingly, the lower arm brace 22 extends along a first offset angle OSA1 of between 0° and 35° (preferably around 19°) relative to a vertical plane 30 extending along a striking surface 32 of the putter head 14. Similarly, the upper arm brace 24 extends along a second offset angle OSA2 of between −5° and 15° (preferably around 4°) relative to the vertical plane 30. The anchor 26 extends along a third offset angle OSA3 of 0° and 45° (preferably around 23°) relative to the vertical plane 30.

The lower arm brace 22 in addition is oriented at a first incline angle IA1 of between 3° and 23° (preferably around 13°) relative to a normal plane 34 that extends normally to vertical plane 30. The first incline angle IA1 preferably corresponds to the incline angle IA of the shaft 16 relative to the putter head 14. The upper arm brace 24 extends at a second incline angle IA2 0° and 30° (preferably around 6°) relative to a normal plane 34.

Referring to FIGS. 6 to 11, two alternative models of putter 10 are shown having different configurations of upper brace member portion 20.

Figure 6:
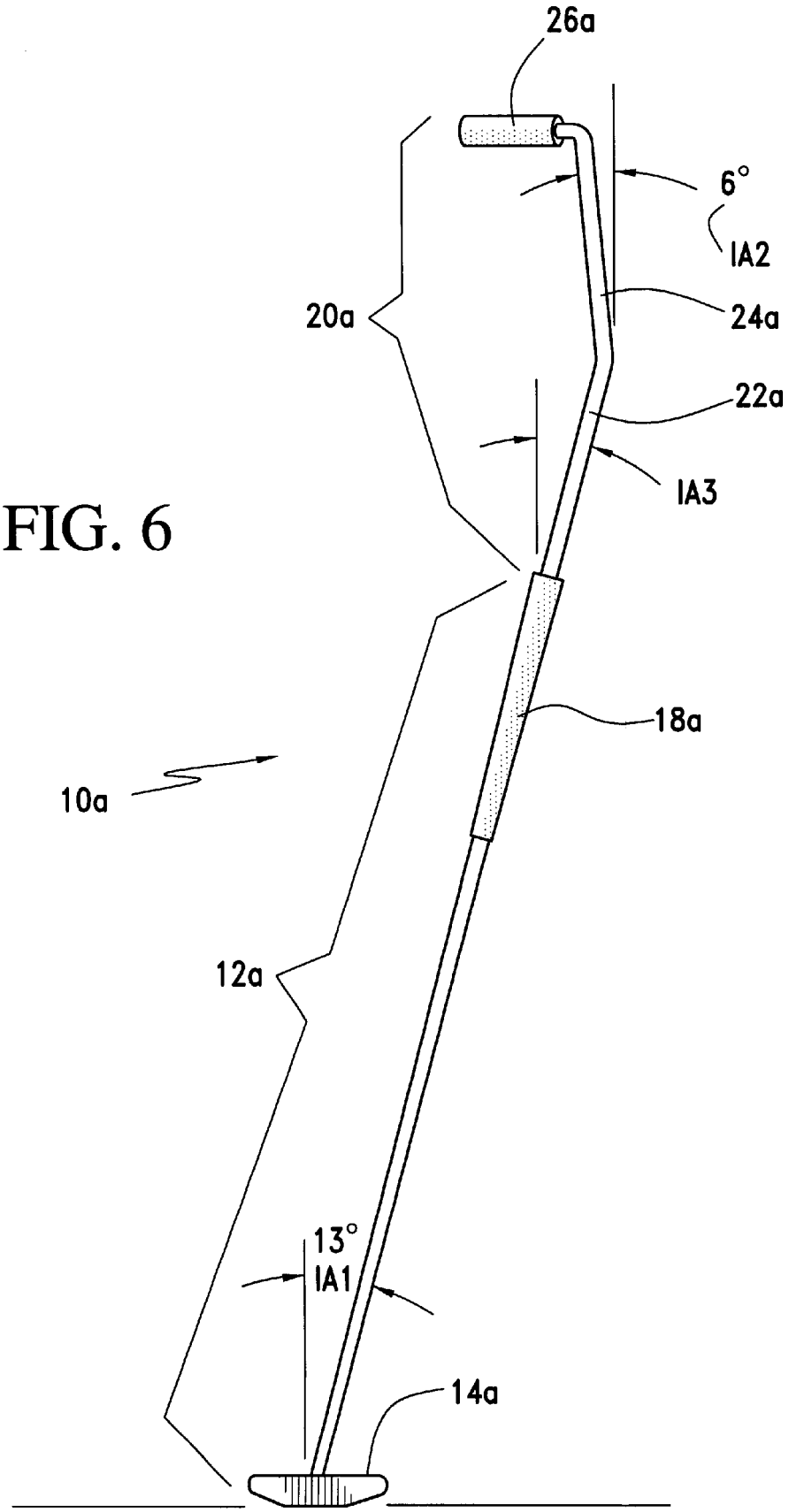
FIG. 6 is a side view of an alternative model of improved golf. putter in accordance with the present invention.
Figure 7:
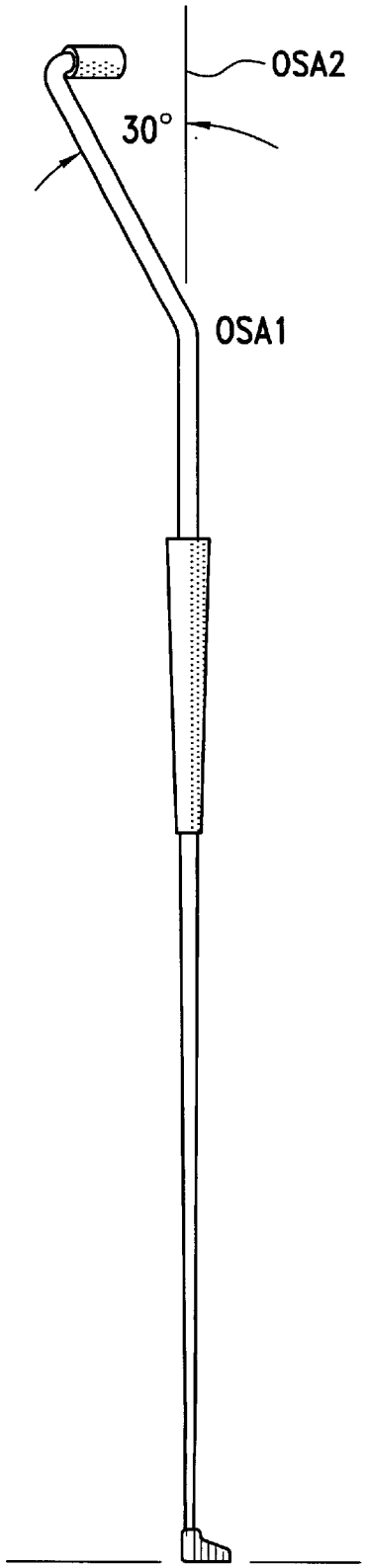
FIG. 7 is a rear view of the golf putter of FIG. 6.
Figure 8:
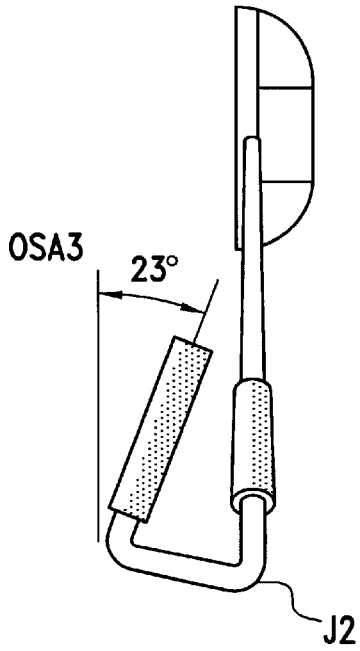
FIG. 8 is a top view of the golf putter of FIG. 6.

The model shown in FIGS. 6 to 8 has a first offset angle OSA1 of 0°, a second offset angle OSA2 of 30° and a third offset angle of OSA3 of 23°. The first incline angle IA1 is 13° and the second incline angle IA2 is 6°. This model of putter 10 has been found to permit more flexibility with hand placement on the grip 18 and will accommodate a longer grip 18 or a larger grip 18.

Figure 9:
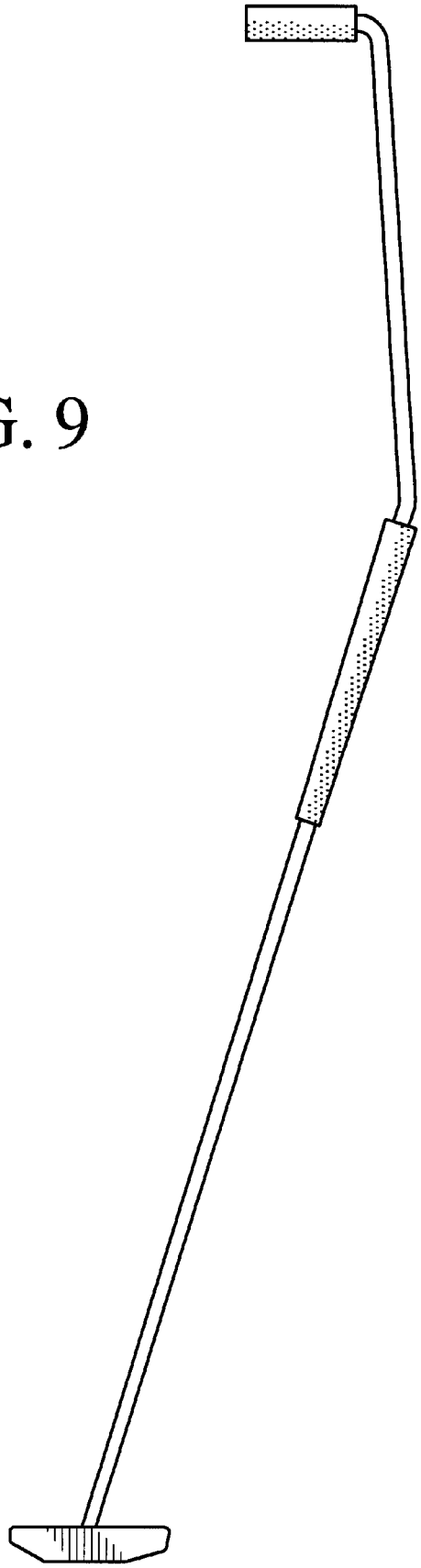
FIG. 9 is a side view of another alternative model of improved golf putter in accordance with the present invention.
Figure 10:
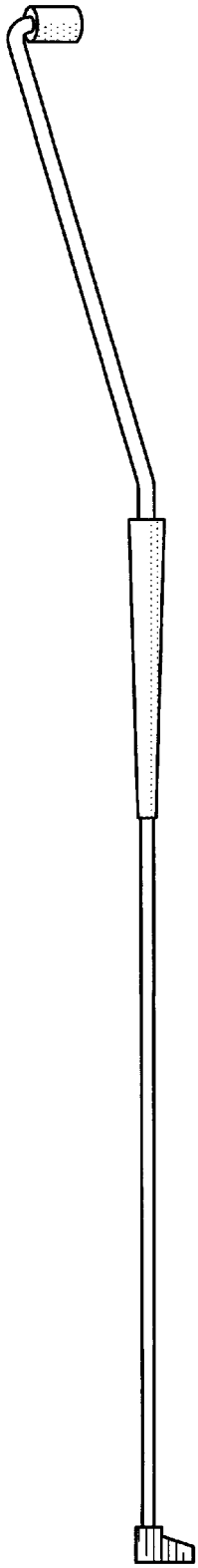
FIG. 10 is a rear view of the golf putter of FIG. 9.
Figure 11:
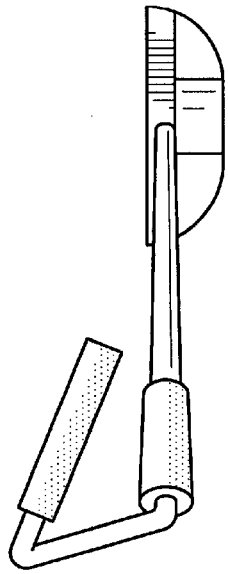
FIG. 11 is a top view of the golf putter of FIG. 9.
Figure 12:
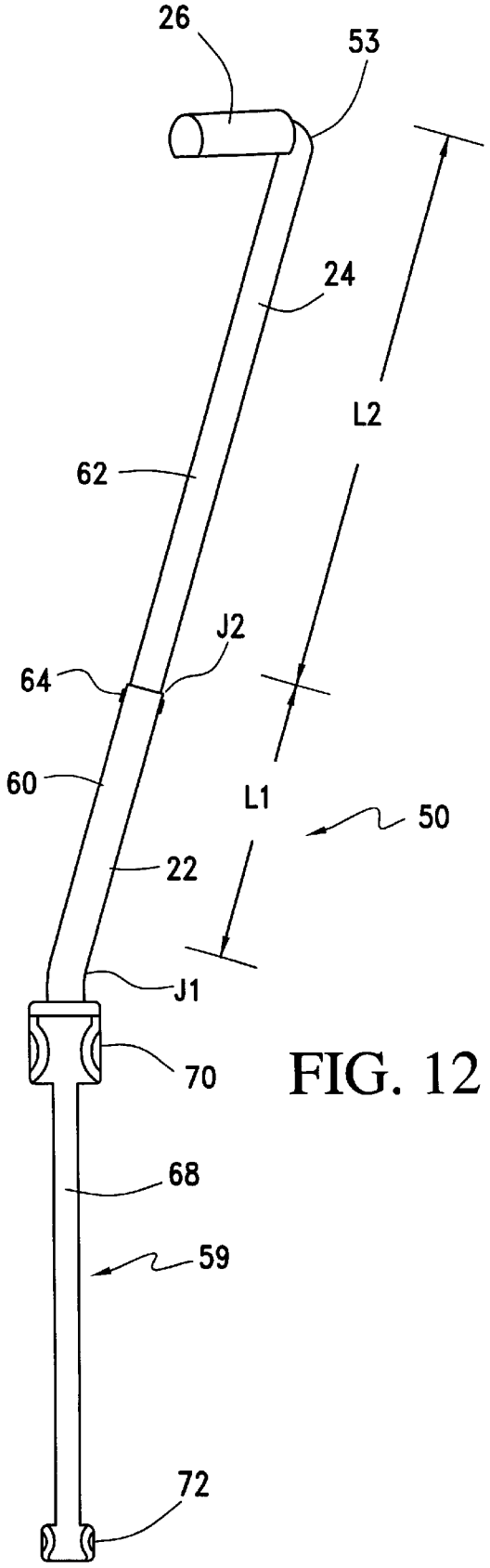
FIG. 12 is a front view of a brace member in accordance with the present invention.
Figure 13:
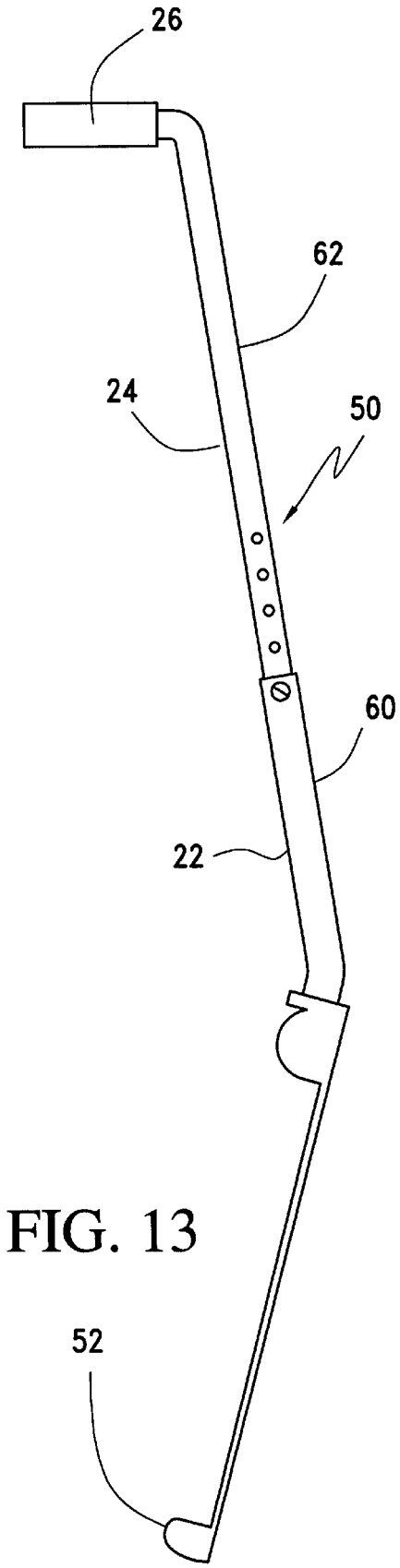
FIG. 13 is a side view of the brace member of FIG. 12.
Figure 14:
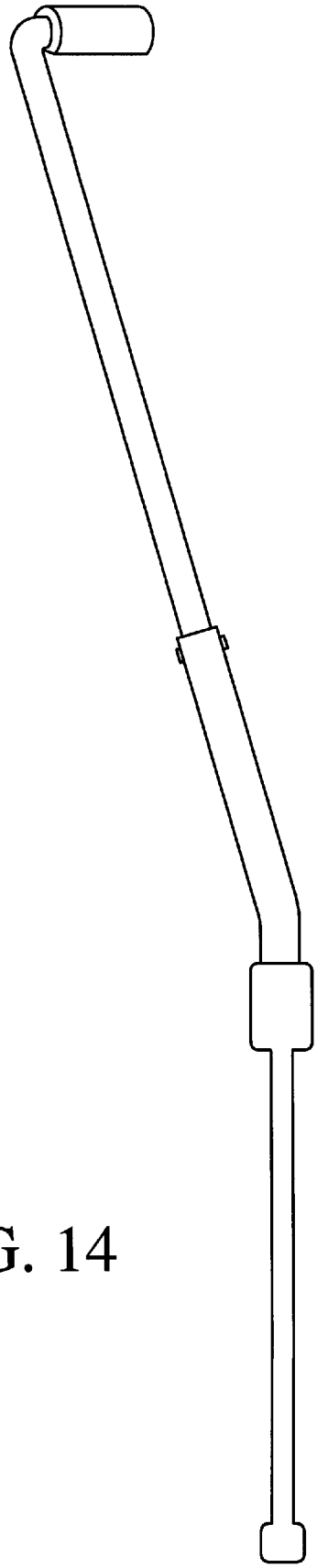
FIG. 14 is a rear view of the brace member of FIG. 12.
Figure 15:
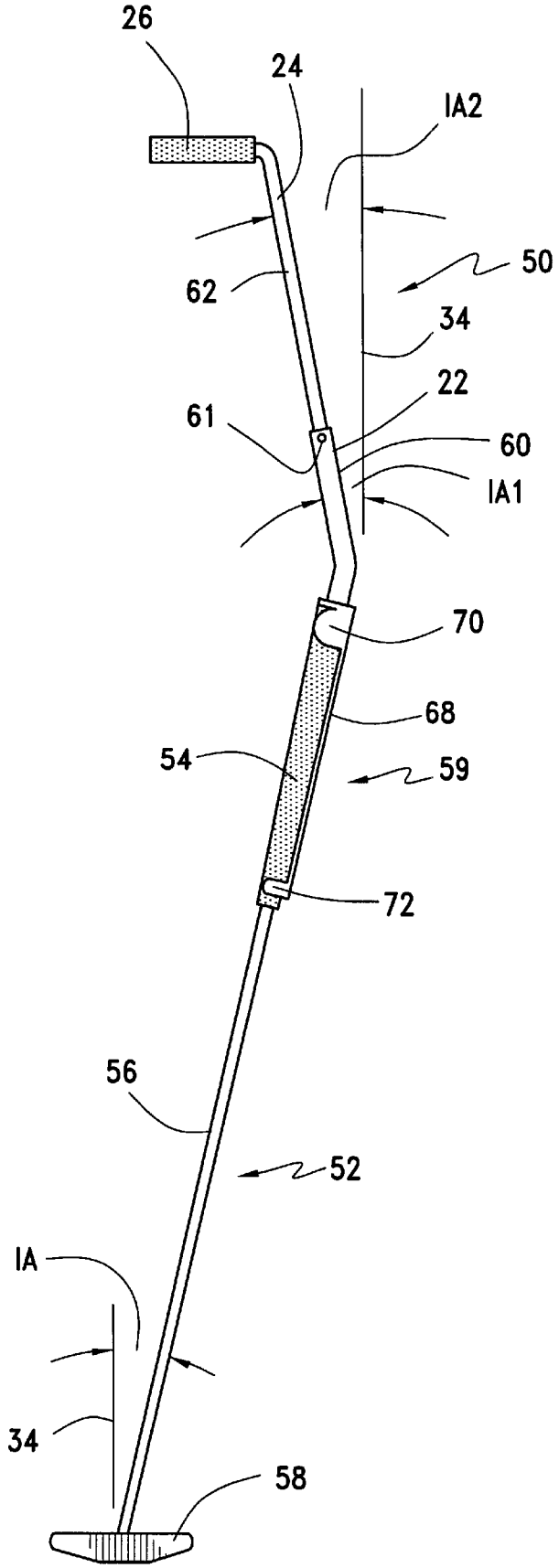
FIG. 15 is a side view of the brace member of FIG. 12 mounted to a conventional golf putter.
Figure 16:
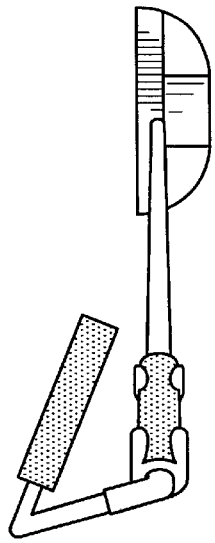
FIG. 16 is a top view of the brace member and golf putter of FIG. 15.
Figure 17:
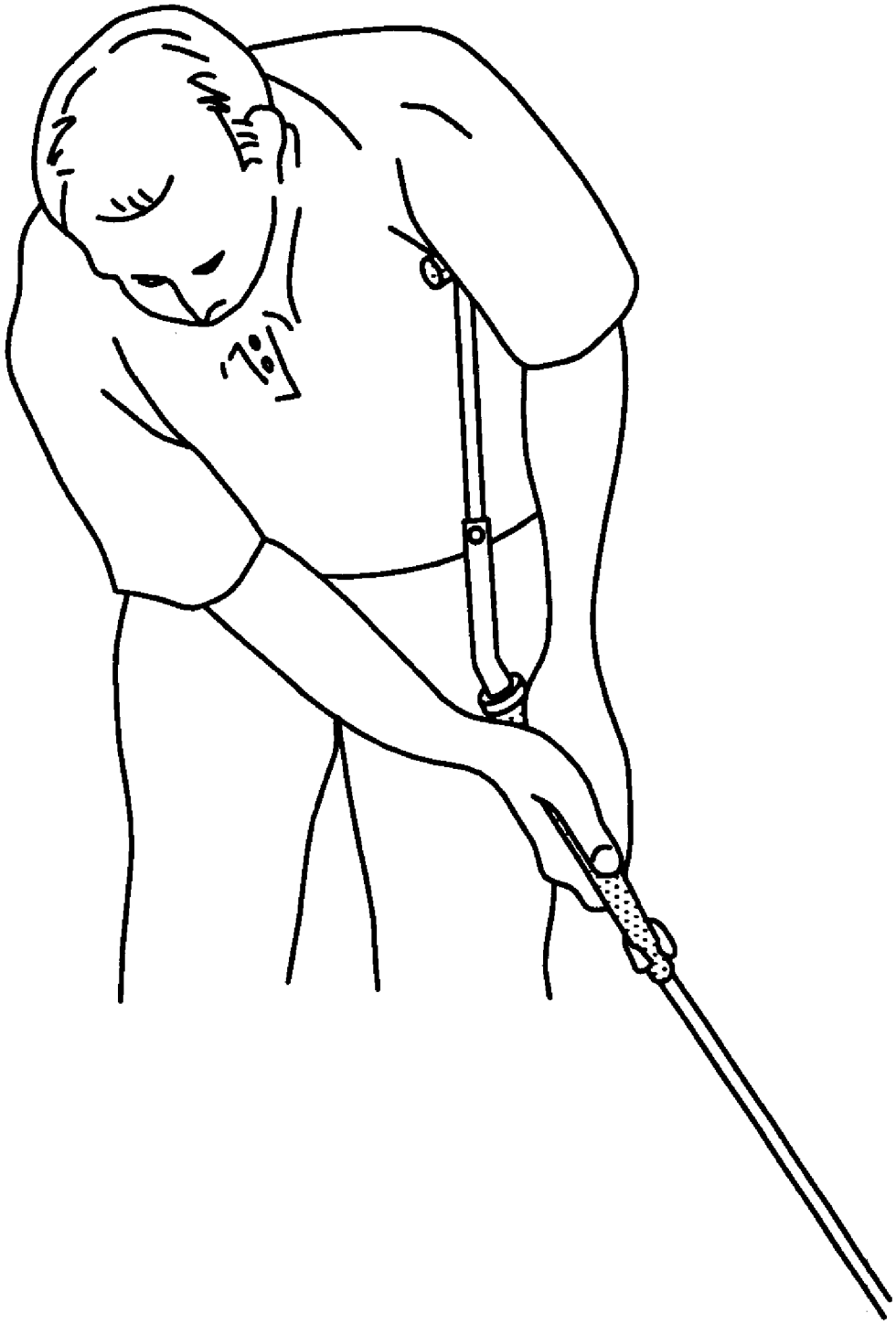
FIG. 17 is a front view of a golfer performing a golf stroke with the race member and golf putter of FIG. 15.

The model shown in FIGS. 9 to 11 has a first offset angle OSA1 of 16°, a second offset angle OSA2 of 16° (ie. the lower arm brace 22 and upper arm brace 24 extend along the same axis relative to vertical plane 30) and a third offset angle OSA3 of 23°. The first incline angle IA1 is 6° and the second incline angle IA2 is 6° (ie. the lower arm brace 22 and upper arm brace 24 also extend along the same axis relative to normal plane 34). This model of putter 10 has been found to minimize interference between the upper brace portion 20 and the golfer's forward arm and to permit more control with the golfer's hands on longer putts.

The joints J1, J2 and J3 may be adjustable to adapt the angular configuration of the upper brace portion 20 to the configuration desired by the individual golfer. If the joints are integrally formed in the upper brace portion 20, a balance of flexibility and rigidity in the joints is desirable to permit angular adjustments to be made (for instance by heating and bending the joints) while still maintaining sufficient rigidity to brace the golfer's arm. If the joints are formed as distinct elements such as ball and socket joints then it is important that such joints be lockable to ensure sufficient rigidity to brace the golfer's arm.

Referring to FIGS. 12 to 17, a removable brace member in accordance with a second embodiment of the present invention is shown generally at 50. The removable brace member 50 is mounted to a conventional putter 52 having a grip 54, a shaft 56 and a putter head 58.

For convenience, elements of the brace member 50 that correspond to elements of the upper brace member portion 20 as described above are assigned corresponding reference numerals.

The brace member 50 includes a lower arm brace 22, an upper arm brace 24 and an anchor 26 constructed and configured with similar lengths and relative angles as the embodiment described above. The brace member 50 also includes a grip attachment 59 for mounting the brace member 50 to the grip 54 of a conventional putter 52.

The lower arm brace 22 and upper arm brace 24 are each formed from first and second elongate tubes 60, 62 that are telescopingly fitted together with a releasable fastener 64 extending through one or more apertures 66 to permit adjustment of the lengths L1 and L2 of the respective braces 22, 24. Releasable fastener 64 may include a spring loaded pin, a bolt and nut or other fasteners known in the art.

The grip attachment 59 includes a body 68 having upper and lower clamps 70 and 72 that extend forwardly from a back surface of the grip attachment 59. The clamps 70, 72 are formed of a flexible resilient material that flexes to receive the putter grip 52 and then clamps against the putter grip 52 to hold it in place. It is preferable that the clamps 70, 72 extend forwardly from the body 68 so that the golfer's hands may wrap around the body 68 of the grip attachment 59 at the rear of the putter grip 52 while the golfer's fingers remain in contact with the front surface of the putter grip 52 to improve the stability of the brace member 50 and to allow the golfer to maintain intimate contact with the putter grip 52. Brace member 50 may be made of rigid plastic or of conventional steel or graphite materials as known for putters.

In use, the golfer places the putter 10 (or putter 52 with adjustable brace member 50) with the anchor 26 under the armpit of his forward arm 28. The golfer grasps the grip 18 with his hands and applies sufficient upward tension in his forward arm 28 to cause his forward arm 28 to be braced between his hands and armpit by the upper brace member portion 20. The bracing of the golfer's forward arm 28 causes the golfer's remaining arm to also be braced with the result that the golfer is placed in a locked triangulated position balanced along center axis A between, the golfer's shoulders. The golfer is then able to perform a pendulum stroke rotating about the golfer's shoulders while the golfer's arms and hands are locked in the triangulated position. In this manner the golfer may use putter 10 (or putter 52 and adjustable brace member 50) during an actual golf game or as a teaching aid for putting. In the case where the putter 10 is used as a training aid, it is conceivable that the putter 10 be used without the putter head 14 mounted to the lower end of the shaft 16. A weight (not shown) might be disposed at the end, or nothing at all, and the golfer could simply use putter 10 as an aid to learning the desired triangulated position for a pendulum stroke.

While the above description constitutes the preferred embodiment, it will be appreciated that the present invention is susceptible to modification and change without parting from the fair meaning of the proper scope of the accompanying claims.

We claim:

1. A golfing aid that promotes the positioning of hands, arms and shoulders in a triangulated position of constant triangle comprising:

an elongate shaft having first and second ends;

a grip disposed on said shaft at an intermediate portion between said first and second ends;

an upper brace portion defined in said shaft between said grip and said second end, said upper brace portion including a substantially planar anchor adjacent to said second end, said anchor being configured to fit comfortably against a golfer's armpit, in the case of a right handed golfer, under the left armpit and vice versa for a left handed golfer, and at least one bend defined in said upper brace portion for locating said anchor against a golfer's armpit while a portion of said shaft located between said grip and said first and is disposed on an axis centered between said golfer's shoulders.

2. A golf putting aid as claimed in claim 1 wherein a putter head is mounted to said first end of said shaft.

3. A golf putting aid as claimed in claim 1 wherein said shaft is integrally formed.

4. A golf putting aid as claimed in claim 1 wherein said upper brace portion further includes a lower arm brace and an upper arm brace, said lower arm brace having a length approximating the length between a golfer's wrist and elbow, said upper arm brace having a length approximating the length between a golfer's elbow and armpit, wherein said bend is located at a joint between said grip and said lower arm brace.

5. A golf putting aid as claimed in claim 1 comprising said upper brace portion further includes a lower arm brace and an upper arm brace, said lower arm brace having a length approximating the length between a golfer's wrist and elbow, said upper arm brace having a length approximating the length between a golfer's elbow and armpit, wherein said bend is disposed at a joint located between said lower arm brace and said upper arm brace.

6. A golf putting aid as claimed in claim 1 wherein said upper brace portion further includes a lower arm brace and an upper arm brace, said lower arm brace having a length approximating the length between a golfer's wrist and elbow, said upper arm brace having a length approximating the length between a golfer's elbow and armpit, wherein said at least one bend comprises a first bend located at a joint between said grip and said lower arm brace and a second bend located at a joint between said lower arm brace and said upper arm brace.

7. A golf putting aid as claimed in claim 1 wherein a sufficient number of said bends are defined in said upper brace portion to permit said upper brace portion to follow the angular orientation of a golfer's arm from the armpit to the wrist when the golfer assumes a triangulated position for putting.

8. A golf putting aid as claimed in claim 7 wherein said upper brace portion is configured to extend along the underside of the golfer's arm when in said triangulated position.

9. A brace member that assists in maintaining the positioning of hands, arms and shoulders in a triangular position of constant triangle, said brace member being mounted to a golf putter having a putter head, a putter shaft and a grip, the brace member comprising;

an elongate shaft having first and second ends, a putter attachment disposed at said first end of said shaft for attaching said brace member to the golf putter, a brace portion defined in said shaft between said putter attachment and said second end, said brace portion including an anchor adjacent to said second end, said anchor being configured to fit comfortably within a golfer's armpit, under the left armpit in the case of a right handed golfer, and vice versa for a left handed golfer, and at least one bend defined defined in said brace portion for locating said anchor against a golfer's armpit while the putter attachment supports the golf putter in an axis centered between the golfer's shoulders.

10. A golf putting aid as claimed in claim 9 wherein said shaft is integrally formed.

11. A golf putting aid as claimed in claim 9 wherein said brace portion further includes a lower arm brace and an upper arm brace, said lower arm brace having a length approximating the length between a golfer's wrist and elbow, said upper arm brace having a length approximating the length between a golfer's elbow and armpit, wherein said bend is located at a joint between said putter attachment and said lower arm brace.

12. A golf putting aid as claimed in claim 9 comprising said brace portion further includes a lower arm brace and an upper arm brace, said lower arm brace having a length approximating the length between a golfer's wrist and elbow, said upper arm brace having a length approximating the length between a golfer's elbow and armpit, wherein said bend is disposed at a joint located between said lower arm brace and said upper arm brace.

13. A golf putting aid as claimed in claim 9 wherein said brace portion further includes a lower arm brace and an upper arm brace, said lower arm brace having a length approximating the length between a golfer's wrist and elbow, said upper arm brace having a length approximating the length between a golfer's elbow and armpit, wherein said at least one bend comprises a first bend located at a joint between said putter attachment and said lower arm brace and a second bend located at a joint between said lower arm brace and said upper arm brace.

14. A golf putting aid as claimed in claim 9 wherein a sufficient number of said bends are defined in said brace portion to permit said brace portion to follow the angular orientation of a golfer's arm from the armpit to the wrist when the golfer assumes a triangulated position for putting.

15. A golf putting aid as in claim 14 wherein said brace portion is configured to extend along an underside of the golfer's arm when in said triangulated position.

16. A brace member for a golf putter that assists the hand, wrists and arms to be maintained in a locked, triangulated position, said putter having a putter head, a shaft and a grip, said brace member comprising;

a lower arm brace extending from the grip parallel to a golfer's arm between the wrist and elbow, an upper arm brace connected to the lower arm brace, the upper arm brace extending at an angle relative to the lower arm brace so as to extend generally parallel to a golfer's arm between the elbow and the armpit when the golfer is in a putting stance, said armpit being the left armpit when the golfer is in a right hand putting stance, and the right armpit when the golfer is in a left and putting stance, a planar anchor connected to the arm brace, the anchor extending generally parallel to the golfer's armpit.

17. A brace member as claimed in claim 16 wherein said lower arm brace extends along an offset angle of between 0° and 35° relative to a vertical plane extending from a striking surface of the putter head.

18. A brace member as claimed in claim 16 wherein said upper arm brace extends along an offset angle of between −5° and 15° relative to a vertical plane extending from a striking surface of the putter head.

19. A brace member as claimed in claim 16 wherein said lower arm brace extends along an incline angle of between 3° and 23° relative to a normal plane normal to the plane of a striking surface of the putter head.

20. A brace member as claimed in claim 16 wherein said upper arm brace extends along an incline angle of between 0° and 30° relative to a normal plane normal to the plane of a striking surface of the putter head.

21. A brace member as claimed in claim 16 wherein said lower arm brace and said upper arm brace are telescopingly connected to each other and fastened with a releasable fastener to permit the length of at least one of said lower arm brace and said upper arm to be adjusted.

22. A brace member as claimed in claim 16 wherein said lower arm brace is integrally connected to said grip.

23. A brace member as claimed in claim 16 wherein said upper arm brace and said lower arm brace are integrally connected.

24. A brace member as claimed in claim 16, further comprising a putter attachment for releasably mounting said brace member to the putter.

* * * * *